US007146947B2

(12) United States Patent
Neubauer et al.

(10) Patent No.: US 7,146,947 B2
(45) Date of Patent: Dec. 12, 2006

(54) ARRANGEMENT FOR ADJUSTING THE ANGLE OF ROTATION OF A CAMSHAFT RELATIVE TO A CRANKSHAFT

(75) Inventors: Dirk Neubauer, Nachrodt-Wiblingwerde (DE); Detlef Axmacher, Iserlohn (DE); Markus Wilke, Nurtingen (DE); Massimiliano Gasparro, Halver (DE); Frank Pachan, Dortmund (DE); Lars Pfutzenreuter, Werdohl (DE)

(73) Assignee: AFT Atlas Fahrzeugtechnik GmbH, Werdohl (DE)

( * ) Notice: Subject to any disclaimer, the term of this patent is extended or adjusted under 35 U.S.C. 154(b) by 0 days.

(21) Appl. No.: 11/156,816

(22) Filed: Jun. 20, 2005

(65) Prior Publication Data

US 2005/0252469 A1 Nov. 17, 2005

Related U.S. Application Data

(63) Continuation of application No. PCT/DE03/02965, filed on Sep. 6, 2003.

(30) Foreign Application Priority Data

Dec. 18, 2002 (DE) ..... 102 59 133

(51) Int. Cl.
*F01L 1/34* (2006.01)

(52) U.S. Cl. ..... 123/90.17; 123/90.11; 251/129.13; 251/129.03; 701/102; 701/105; 701/115

(58) Field of Classification Search ..... 123/90.17
See application file for complete search history.

(56) References Cited

U.S. PATENT DOCUMENTS

| | | | | |
|---|---|---|---|---|
| 5,209,202 | A * | 5/1993 | Maurer et al. | 123/406.18 |
| 5,218,935 | A | 6/1993 | Quinn, Jr. et al. | |
| 5,245,968 | A * | 9/1993 | Kolias et al. | 123/480 |
| 5,548,995 | A * | 8/1996 | Clinton et al. | 73/116 |
| 5,680,837 | A | 10/1997 | Pierik | |
| 6,505,113 | B1 * | 1/2003 | Eichenseher et al. | 701/114 |
| 6,505,587 | B1 * | 1/2003 | Scheidt | 123/90.17 |
| 6,523,512 | B1 * | 2/2003 | Axmacher et al. | 123/90.17 |
| 2002/0017257 | A1 | 2/2002 | Axmacher et al. | |

FOREIGN PATENT DOCUMENTS

| | | |
|---|---|---|
| DE | 36 31 733 | 3/1988 |
| DE | 196 40 943 | 5/1997 |
| DE | 101 16 707 | 10/2002 |

* cited by examiner

*Primary Examiner*—Thomas Denion
*Assistant Examiner*—Kyle M. Riddle
(74) *Attorney, Agent, or Firm*—Volpe and Koenig, P.C.

(57) ABSTRACT

An arrangement for adjusting the angle of rotation of a camshaft (5) relative to a crankshaft is provided. The arrangement requires many components, which partially also require different operational conditions. The new arrangement is structured in a modular fashion, so that the components of the arrangement are no longer arranged inside a common housing, but rather are separately constructed according to their function and/or operational conditions, for example, they are used jointly by other control or adjustment devices. It is particularly advantageous that such arrangements can be produced in a reduced size and in a more cost effective manner and can be used for adjusting the valve play of internal combustion engines.

19 Claims, 3 Drawing Sheets

ARRANGEMENT FOR ADJUSTING THE ANGLE OF ROTATION OF A CAMSHAFT RELATIVE TO A CRANKSHAFT

BACKGROUND

The invention relates to an arrangement for adjusting the angle of rotation of a camshaft relative to a crankshaft of an internal combustion engine.

In internal combustion engines, the crankshaft drives one or more camshafts via a primary drive, which may be provided as a toothed belt, for example. For this purpose, a camshaft timing gear is mounted on each camshaft, by which the primary drive drives the camshaft. Here, at all times a transmission of the angle of rotation of the camshaft occurs, in which a 720° angle of rotation of the crankshaft $\phi_K$ is transmitted into a 360° angle of rotation of the camshaft $\phi_N$. Therefore, through this coupling the two angles of rotation are constant in reference to one another. In most applications, this fixed coupling of crankshaft and camshaft results in a ratio of $$\frac{\varphi N(t)}{\varphi K(t)} = \frac{1}{2}$$

However, the operational characteristics of an internal combustion engine can be optimized, particularly with regard of fuel consumption, exhaust emission, and running performance, when the system of camshaft and crankshaft, coupled via the primary drive, can be modified.

DE 100 38 354 A1 discloses an arrangement for adjusting the angle of rotation of a camshaft relative to a crankshaft through the use of a wobble plate mechanism. Here, a second drive additionally acts on the camshaft via the wobble plate mechanism, which is arranged between the camshaft timing gear and the camshaft. This causes the camshaft to be adjustable in reference to the crankshaft.

SUMMARY

The objective of the invention is to provide a simple and cost effective arrangement for adjusting the angle of rotation of the camshaft relative to the crankshaft.

This objective is met using the features according to the invention. Here, such an arrangement is constructed in a modular fashion, so that the various tasks of such an arrangement are distributed to several control devices, which again may be arranged independent from one another.

The advantage of the invention lies in such a construction being very cost effective because functions of other control devices can be used as well. An additional advantage of the invention is the fact that individual control devices of the arrangement can be reduced in size. Such an arrangement also allows the distribution of the tasks to the module most suitable therefor, depending on certain mechanical and/or electrical parameters, such as e.g., capacity, current, and voltage, in particular to control devices, which are most appropriate to the requirements.

Advantageous further developments are also provided. Preferably, the target value of the motor control can be predetermined. It is also advantageous, if the target value refers to a value of an angle, a rotational speed, power, or rotational moment, which are particularly easy to measure and adjust.

BRIEF DESCRIPTION OF THE DRAWINGS

The invention is explained in further detail using an exemplary embodiments as illustrated in the figures, which show.

DETAILED DESCRIPTION OF THE PREFERRED EMBODIMENTS

Figure 1:
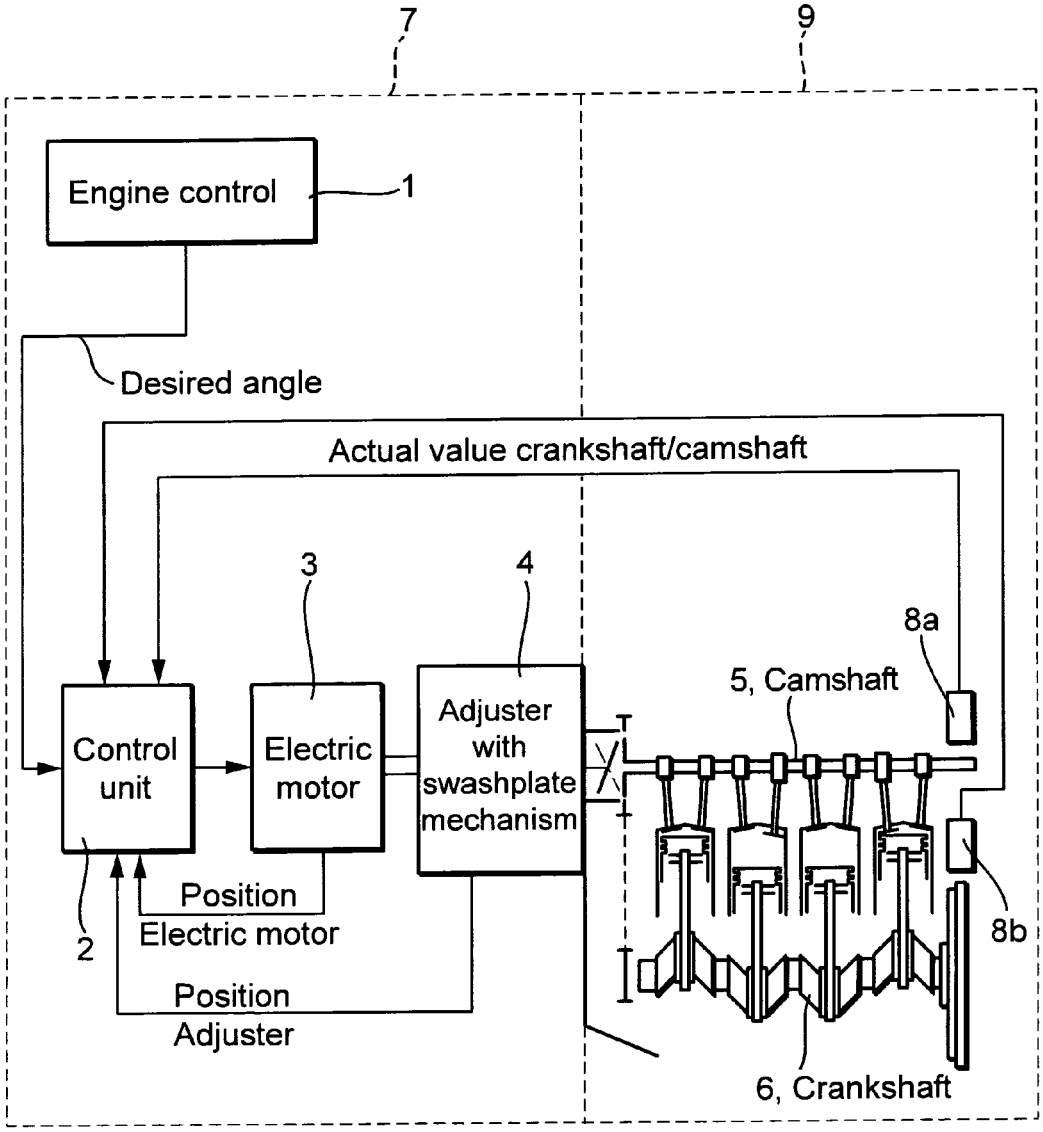
FIG. 1 is a schematic view showing an arrangement with a predetermined target angle according to the invention.

FIG. 1 shows an arrangement, in which the target value for the control device 7 of the motor control device 1 is predetermined. Here, it relates to a target angle, which is to be adjusted as a predetermined rotation angle of the crankshaft 6 relative to the camshaft 5. This changes the angle of rotation of the two shafts 5, 6 relative to one another. The motor control device 1, predetermining said target angle, essentially controls the internal combustion engine, which drives the crankshaft 6. This target angle serves as a reference value for the second control device 2, which simultaneously collects the measurements of sensors 8*a*, 8*b*, collecting the actual value of the dimension to he adjusted. Here, for example, sensors 8*a*, 8*b* can measure the position of the camshaft and the crankshaft 5, 6. Measuring the position of the camshaft and the crankshaft 5, 6 determination of the angle of rotation in reference to one another. This angle of rotation can be modified by the adjuster 4. In the exemplary embodiment, the value of the target angle is forwarded from the motor control device 1 to a second control device 2. The second control device 2 controls an electric motor 3, which operates the adjuster 4. In the exemplary embodiment, the second control device 2 for the electric motor 3 comprises the final stage for adjusting the electric motor 3 and the adjustment of the position of the arrangement. The arrangement shown represents a circuit having a control device 7 and a control path 9, with the control path comprising the camshaft and the crankshaft 5, 6, with the angle of rotation relative to one another being modified and the control device being assembled with the following components:

- a target value adjuster composed from several control devices 1, 2, with the target value being generated by the motor control 1, transferred to the control device 2, in which the switching mechanism for adjusting the target value is located.
- a measuring device, in the exemplary embodiment formed by the sensors 8*a*, 8*b* at the camshaft and/or crankshaft and comprising sensors, alternately or additionally, for recognizing the position of the electric motor and/or the adjuster.
- a comparator comparing the target value to the actual value, with this function in the exemplary embodiment also being integrated in the control device 2,
- and an adjustment member adjusting the angle of rotation of the camshaft, which in the exemplary embodiment is formed by the electric motor 3 and the adjuster 4.

Figure 2:
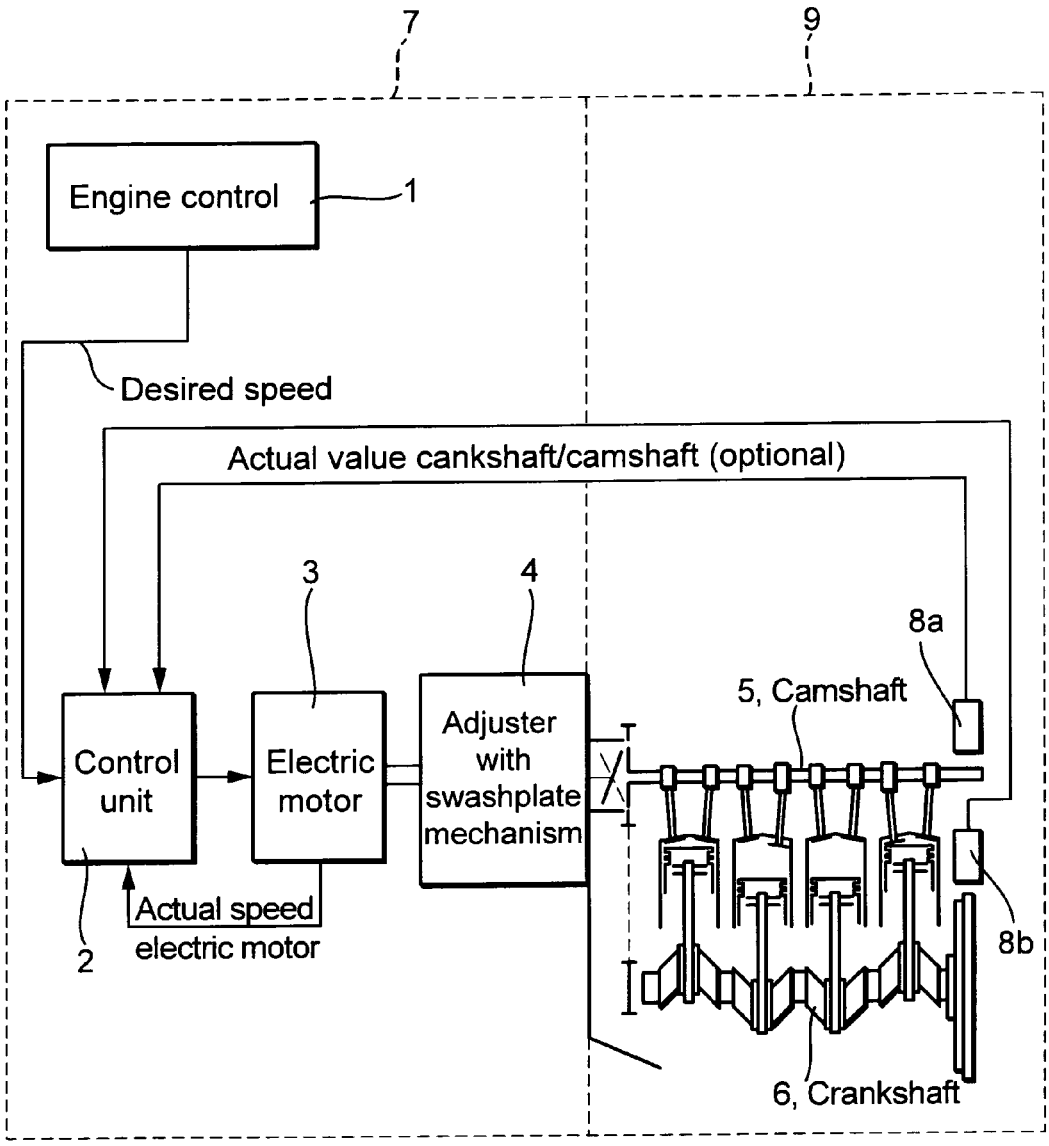
FIG. 2 is a schematic view showing an arrangement with a predetermined target rotational speed according to the invention.

FIG. 2 also shows an arrangement, in which the target value for the control device 7 is predetermined by the motor control 1. However, here the target angle is not determined and forwarded directly, rather the target rotational speed for the electric motor 3 is determined and forwarded by the motor control 1 of the internal combustion engine, by which the desired angle of the rotation of the crankshaft relative to the camshaft can be adjusted.

This target rotational speed serves as a reference value for the control device 2, which can simultaneously process the measurements of the sensors 8*a*, 8*b* representing the actual value of the control variable of the angle of rotation. For example, said sensors 8*a*, 8*b* can measure the position of the camshaft and the crankshaft 5, 6 in the control path 9. Alternately or additionally, the rotational speed of the electric motor 3 at a certain time can be measured, and then compared in the control device 2 to a target value. The control device 2 for the electric motor 3 also includes the final stage for controlling the electric motor 3. However, the control of the position of the arrangement is performed by the motor control 1, which varies the target rotational speed accordingly until the desired state of the camshaft relative to the crankshaft has been achieved. However, this adjustment of the position can also be realized in a different arrangement. Certainly, the control device 2 may also perform other functions. The arrangement shown represents a circuit with a control device 7 and a control path 9, with the control path comprising the camshaft and the crankshaft 5, 6, and their angle of rotation relative to one another being modified, and the control device being assembled from the following components:

- a target value adjuster assembled from several control devices 1, 2, with the target value being generated by the motor control 1, which is transferred to the control device 2, comprising the final stage for the electric motor. Here, the position adjustment can be provided either in the motor control 1 or in the control device 2.
- a measuring device, in the exemplary embodiment formed at the electric motor 3 in the form of a tachometer and/or by the sensors 8*a* and 8*b* according to the previous exemplary embodiment.
- a comparator comparing the actual value to the target value, with the function also being integrated in the control device 2 in the exemplary embodiment.
- and the actuator controlling the angle of rotation of the camshaft, which in the exemplary embodiment comprises the electric motor 3 and the adjustment device 4.

The individual electric and electronic functions and tasks are performed at different locations in the arrangement. In particular, other control devices or gadgets handle partial tasks and/or partial functions of the arrangement. Similarly, it is not mandatory for the above-mentioned components to be located in the same housing. The control of the target rotational speed of the adjuster 4 is equivalent to the above-described control of the target rotational speed of the electric motor 3, because the rotational speed of the adjuster 4 is directly dependent on the rotational speed of the electric motor 3.

Figure 3:
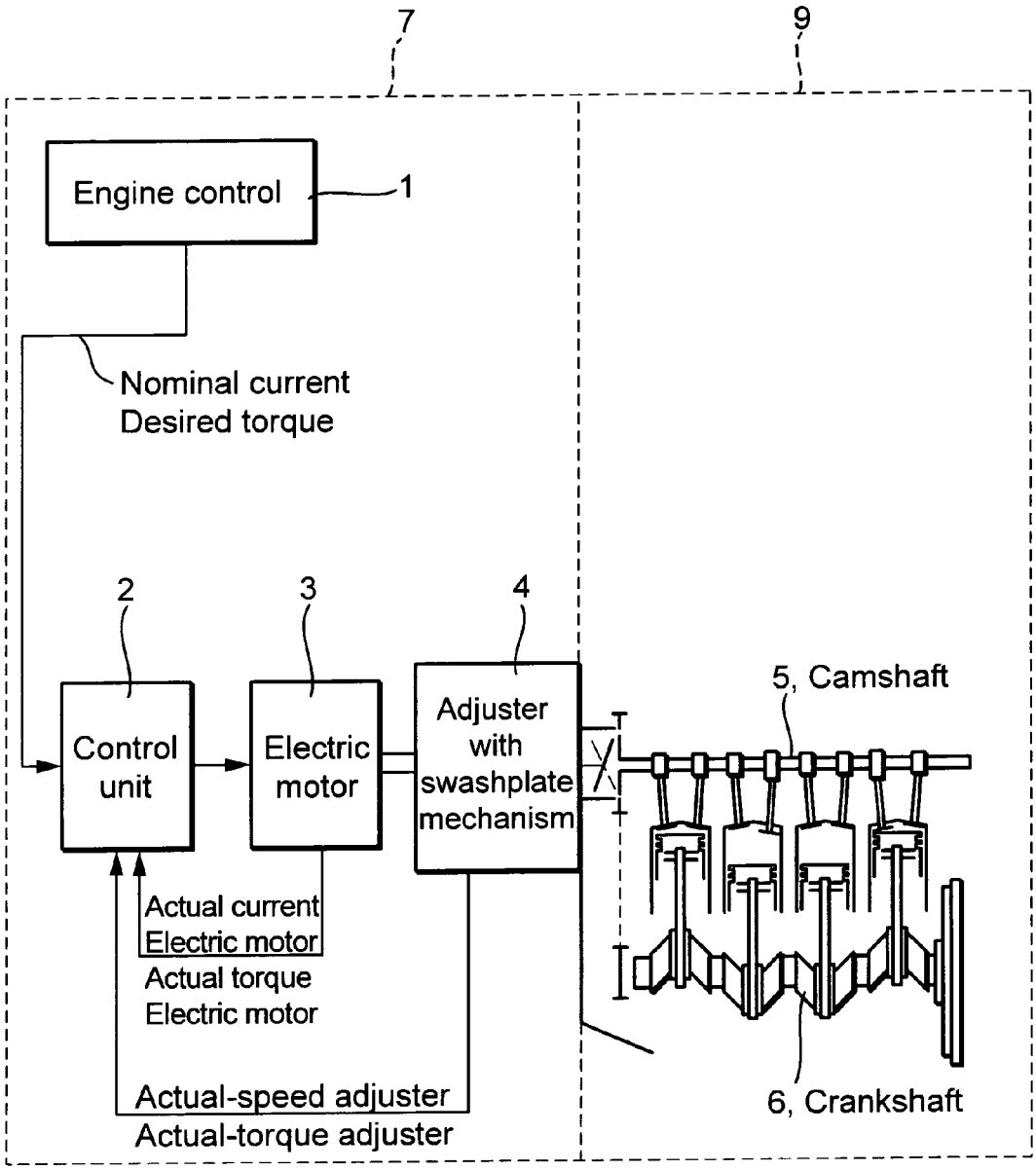
FIG. 3 is a schematic view showing an arrangement with a predetermined power and/or target moment.

FIG. 3 shows an arrangement, in which the target value for the control device 7 is predetermined by the motor control device 1 for the control device 2 in the form of a target current or a target moment for the electric motor 3. The target current and/or target moment indirectly determines and/or modifies the angle of rotation of the camshaft relative to the crankshaft 6, 7. The amount of target current and moment used is predetermined by the motor control device. The target value of the motor control 1 is forwarded by the control device 2. Here, the value affects the operational parameters for the electric motor 3, which again more or less directly drives the adjuster 4. Here too, in this exemplary embodiment, the adjuster 4 is provided with a wobble plate mechanism, which is connected to the camshaft 5, driven by the crankshaft 6. In order to determine if the target value in the control device has been reached, actual real values in the electric motor 3 and also in the adjuster are collected and provided for the control device as control values for variance comparison.

Here, too, the motor control device 1 determines the target current or the target moment, i.e., essentially controls the internal combustion engine, which drives the camshaft 6. The target value of the current and/or the moment serves as a reference value for the control device 2, which simultaneously collects the measurements at the electric motor 3 and/or at the adjuster 4, representing the actual comparison value in reference to the target value. Here, the adjustment path comprises the camshaft and the crankshaft 5, 6, with their relative angle of rotation with respect to one another being modified by way of the modifying operational current of the electric motor and, thus, also of the torque and/or the rotational speed of the electric motor and/or the adjuster being modified. The corresponding control device is assembled from the following components:

- a target value adjuster, with the target value being generated and updated by the motor control 1 and the target value being transferred to the control device 2, containing the switch, by which this target value can be adjusted.
- a measuring device, in the exemplary embodiment measuring a current, a rotational speed, or a torque at the electric motor or at the adjuster, which provides an actual value for the control device 2 for a comparison to the target value.
- a comparator, comparing the actual value to the target value, with this function in the exemplary embodiment being integrated in the control device 2.
- and the actuator, influencing the angle of rotation of the camshaft 5 and being formed by the electric motor 3 and the adjuster 4 in the exemplary embodiment.

The individual electric and electronic functions and tasks are reformed at different positions in the arrangement. In particular, other control devices or arrangements cover partial tasks and/or partial functions of the arrangement. Similarly, it is not necessary for the above-mentioned components to located in the same housing, rather they can be installed and/or integrated in various devices, which are provided with additional functions.

All the exemplary embodiments can be combined in an arbitrary manner, it is only important that the control device has a modular structure.

LIST OF REFERENCE CHARACTERS

1 Motor control
2 Control device
3 Electric motor
4 Adjustor having a swash plate mechanism
5 Camshaft
6 Crankshaft
7 Control device
8*a* Sensor
8*b* Sensor
9 Control path

The invention claimed is:

1. An arrangement for adjusting an angle of rotation of a camshaft (5) relative to a crankshaft (6) of an internal combustion engine, comprising:

a camshaft adjuster (4) that adjusts the angle of rotation of the camshaft (5) relative to the angle of rotation of the crankshaft (6), an electric motor (3) driving the camshaft adjuster (5), a first control device (2) that acquires an actual value of the angle of rotation of the camshaft (3) relative to the crankshaft (6), and controls the electric motor (3) depending upon a target value for the angle of rotation of the camshaft (5) relative to the angle of rotation of the crankshaft (6), a second control device (1) connected to the first control device (2), the second control device (1) predetermining the target value of the angle of rotation of the camshaft (5) in the first control device (2) and communicating the predetermined target value to the first control device (2);

wherein the first control device acquires the actual value independent of the second control device.

2. An arrangement according to claim 1, further comprising a measuring device (8*a*, 8*b*), which determines an actual value describing the angle of rotation at a given time, the first control device (2) for the electric motor (3) includes a comparison device for comparing the target value to the actual value.

3. An arrangement according to claim 2, further comprising a control that acts on the first control device (2) until the actual value coincides with the target value, the control is integrated in the first control device (2).

4. An arrangement according to claim 2, further comprising a control that acts on the first control device (2) until the actual value coincides with the target value, the control is integrated in the second control device (1).

5. An arrangement according to claim 2, further comprising a control that acts on the first control device (2) until the actual value coincides with the target value, the control is integrated in a third control device.

6. An arrangement according to claim 1, further comprising a measuring device (8*a*, 8*b*) which determines an actual value describing the angle of rotation at a given time, the second control device (1) includes a comparison device for comparing the target value to the actual value.

7. An arrangement according to claim 1, further comprising a measuring device (8*a*, 8*b*) which determines an actual value describing the angle of rotation at a given time, the arrangement includes a comparison device for comparing the target value to the actual value and said comparison device is connected to at least one of the two control devices (1, 2).

8. An arrangement according to claim 1, wherein the second control device (1) comprises a motor control device for the internal combustion engine driving the camshaft (5).

9. An arrangement according to claim 8, further comprising a measuring device (8*a*, 8*b*), which determines an actual value describing the angle of rotation at a given time, the first control device (2) for the electric motor (3) includes a comparison device for comparing the target value to the actual value.

10. An arrangement according to claim 9, further comprising a control that acts on the first control device (2) until the actual value coincides with the target value, the control is integrated in the first control device (2).

11. An arrangement according to claim 9, further comprising a control that acts on the first control device (2) until the actual value coincides with the target value, the control is integrated in the second control device (1).

12. An arrangement according to claim 9, further comprising a control that acts on the first control device (2) until the actual value coincides with the target value, the control is integrated in a third control device.

13. An arrangement according to claim 8, further comprising a measuring device (8*a*, 8*b*) which determines an actual value describing the angle of rotation at a given time, the second control device (1) includes a comparison device for comparing the target value to the actual value.

14. An arrangement according to claim 8, further comprising a measuring device (8*a*, 8*b*) which determines an actual value describing the angle of rotation at a given time, the arrangement includes a comparison device for comparing the target value to the actual value and said comparison device is connected to at least one of the two control devices (1, 2).

15. An arrangement for adjusting an angle of rotation of a camshaft (5) relative to a crankshaft (6) of an internal combustion engine, comprising:

a camshaft adjuster (4) that adjusts the angle of rotation of the camshaft (5) relative to the angle of rotation of the crankshaft (6), an electric motor (3) driving the camshaft adjuster (5), a first control device (2) that acquires actual data for the camshaft (3) relative to the crankshaft (6), and controls the electric motor (3) depending upon target data for the camshaft (5), a second control device (1) connected to the first control device (2), the second control device (1) predetermining the target data and communicating the predetermined target data to the first control device (2);

wherein the first control device acquires the actual value independent of the second control device.

16. The arrangement of claim 15 wherein the target data and the actual data correspond to angles of rotation between the camshaft (5) and the crankshaft (6).

17. The arrangement of claim 15 wherein the target data and the actual data correspond to rotational speeds of the camshaft (5) relative to the crankshaft (6).

18. The arrangement of claim 15 wherein the target data and the actual data correspond to a moment of the electric motor (3).

19. The arrangement of claim 15 wherein the target data and the actual data correspond to a current in the electric motor (3).

* * * * *